US009462903B2

(12) United States Patent
Laurain

(10) Patent No.: US 9,462,903 B2
(45) Date of Patent: Oct. 11, 2016

(54) SURFACE CONTACT SELF-SEALING INTEGRATED TABLEWEAR AND DINING MAT

(71) Applicant: Lindsey Laurain, Parker, CO (US)

(72) Inventor: Lindsey Laurain, Parker, CO (US)

( * ) Notice: Subject to any disclaimer, the term of this patent is extended or adjusted under 35 U.S.C. 154(b) by 62 days.

(21) Appl. No.: 14/333,682

(22) Filed: Jul. 17, 2014

(65) Prior Publication Data

US 2016/0073805 A1 Mar. 17, 2016

(51) Int. Cl.

| | |
|---|---|
| ***A47G 19/10*** | (2006.01) |
| ***A47G 19/02*** | (2006.01) |
| ***A47G 23/03*** | (2006.01) |

(52) U.S. Cl.
CPC ..... *A47G 19/10* (2013.01); *A47G 19/02* (2013.01); *A47G 23/0303* (2013.01)

(58) Field of Classification Search
CPC ... A47G 19/02; A47G 19/10; A47G 23/0303
USPC ..... 220/575, 574, 500
See application file for complete search history.

(56) References Cited

U.S. PATENT DOCUMENTS

| | | | | |
|---|---|---|---|---|
| 5,053,262 | A * | 10/1991 | Kerr | 428/81 |
| 8,684,218 | B1 * | 4/2014 | Stravitz | 220/504 |
| 2003/0152736 | A1 * | 8/2003 | Bass | 428/40.1 |
| 2005/0056642 | A1 * | 3/2005 | Lion | 220/4.22 |

* cited by examiner

*Primary Examiner* — Fenn Mathew
*Assistant Examiner* — Elizabeth Volz
(74) *Attorney, Agent, or Firm* — Williams Intellectual Property; Benjamin F. Williams

(57) ABSTRACT

A self-sealing integrated tableware and dining mat including a rubberlike planar portion having a raised perimeter delimiting at least one concavity above an upper surface and a suffuse undersurface disposed for sealable contact with an underlying surface upon which said mat is disposed, said sealable contact preventative of lateral displacement of the planar portion across the underlying surface, wherein said sealable contact creates a partial vacuum when attempts to separate the undersurface from the underlying surface are made except at an outer edge of the planar portion, whereby removal of the planar portion from the underlying surface is effective only by peeling the undersurface from the underlying surface starting first at the outer edge.

9 Claims, 3 Drawing Sheets

SURFACE CONTACT SELF-SEALING INTEGRATED TABLEWEAR AND DINING MAT

BACKGROUND OF THE INVENTION

Various types of tableware and associated placemats are known in the prior art devised for use by infants and children at mealtime. However, what is needed is a surface contact self-sealing integrated tableware and dining mat that includes an impervious, rubberlike planar portion having a raised perimeter delimiting at least one concavity above an upper surface, and a suffuse undersurface disposed for sealable contact with an underlying surface upon which said mat is disposed, said sealable contact preventative of lateral displacement of the planar portion across the underlying surface, wherein said sealable contact creates a partial vacuum when attempts to separate the undersurface from the underlying surface are made except at an outer edge of the planar portion, whereby removal of the planar portion from the underlying surface is effective only by peeling the undersurface from the underlying surface starting first at the outer edge.

FIELD OF THE INVENTION

The present invention relates to a surface contact self-sealing integrated tableware and dining mat, and more particularly, to a self-sealing integrated tableware and dining mat including an impervious rubberlike planar portion having a raised perimeter delimiting at least one concavity above an upper surface and a suffuse undersurface disposed for sealable contact with an underlying surface upon which said mat is disposed, said sealable contact preventative of lateral displacement of the planar portion across the underlying surface, wherein said sealable contact creates a partial vacuum when attempts to separate the undersurface from the underlying surface are made except at an outer edge of the planar portion, whereby removal of the planar portion from the underlying surface is effective only by peeling the undersurface from the underlying surface starting first at the outer edge.

SUMMARY OF THE INVENTION

The general purpose of the surface contact self-sealing integrated tableware and dining mat, described subsequently in greater detail, is to provide a surface contact self-sealing integrated tableware and dining mat which has many novel features that result in a surface contact self-sealing integrated tableware and dining mat which is not anticipated, rendered obvious, suggested, or even implied by prior art, either alone or in combination thereof.

Many a parent knows the inconvenience of having to clean up after their children's mealtimes. Young children especially can be quite messy, even dislodging and upturning their plates and bowls to spill foodstuffs and beverages everywhere. What is needed is a surface contact self-sealing integrated tableware and dining mat, whereby tableware (including bowls, plates, and other such concavities and receptacles as are suited for delimiting foodstuffs therein) is not separable from an underlying planar portion or placemat, and lateral displacement and simple overturning of said mat is preventable.

The present surface contact self-sealing integrated tableware and dining mat, therefore, enables a planar portion devised for sealable contact upon an underlying surface, wherein lateral displacement of said planar portion upon said underlying surface is preventable and a partial vacuum, creatable between the planar portion and said underlying surface when attempts to lift the planar portion away from said underlying surface are effected, prevents separation of the planar portion from the underlying surface except when said planar portion is first peeled away from said underlying surface at an outer edge of said planar portion. Thus the present surface contact self-sealing integrated tableware and dining mat resists displacement and overturning effected by a clumsy or deliberate child, whereby foodstuffs are effectively maintained at a desired position upon a tabletop, for example, and spilled foodstuffs are catchable upon said planar portion and thereat removed from contact with the underlying surface for ready and expedient cleanup subsequent completion of the mealtime.

The present surface contact self-sealing integrated tableware and dining mat, therefore, includes an impermeable planar portion delimited by an outer edge. The outer edge defines the outermost extremity of the planar portion. The planar portion includes an undersurface and an upper surface, as will be described subsequently.

The undersurface has a high coefficient of friction, defined herein as enabling contact upon a vertical surface, and maintaining said contact by tractive engagement therewith capable of supporting the weight of planar portion thereon. Thus, the planar portion is capable of maintaining position and contact with a vertically oriented surface when applied thereto by means of the high coefficient of friction of the undersurface.

The undersurface also effects sealable contact with an underlying surface. Lifting the planar portion anywhere except at the outer edge, therefore, creates a partial vacuum between the undersurface and said underlying surface, whereby frictional resistance to lateral displacement and sealable contact impervious to passage of air or fluids resist separation of the planar portion from the underlying surface. Removal of the planar portion from an underlying surface is thus best effected at the outer edge, whereat sealable contact is breakable and creation of the partial vacuum is avoidable.

The upper surface includes a raised perimeter centrally disposed thereon, said raised perimeter defining a concavity atop the planar portion upper surface. The concavity is contemplated to include at least one receptacle wherein foodstuffs are storable, as desired, for ingestion therefrom. The at least one receptacle is contemplated to include a bowl and, alternately, an ovoid portion having at least a pair of receptacles therein, whereby dissimilar foodstuffs are storable within the concavity separated and distinct for ingestion therefrom, as desired.

Since the concavity and at least one receptacle are integrated with the planar portion upper surface, said concavity and at least one receptacle are not separable therefrom, and lateral displacement and spillage are thereby preventable by inadvertent or deliberate knocking by a child. Moreover, the planar portion acts to anchor the concavity and at least one receptacle in a desired position upon an underlying surface, thereby preventative of inadvertent or mischievous tampering by a child at mealtime.

In the preferred embodiment herein disclosed, the surface contact self-sealing integrated tableware and dining mat is contemplated to be made from silicone, or another nontoxic rubberlike polymer, yielding to the touch, and having an undersurface enabling sealable contact with an underlying surface such as a tabletop, said undersurface having a high coefficient of friction resistive of lateral displacement thereon. Thus, the surface contact self-sealing integrated tableware and dining mat provides an all-in-one tableware and placemat for children, yielding to the touch, resistive to displacement, overturning, or spillage, and appropriate to catch spilled foods during ingestion by a child, whereby expedient cleanup after mealtime is effective.

Thus has been broadly outlined the more important features of the present surface contact self-sealing integrated tableware and dining mat so that the detailed description thereof that follows may be better understood and in order that the present contribution to the art may be better appreciated.

Objects of the present surface contact self-sealing integrated tableware and dining mat, along with various novel features that characterize the invention are particularly pointed out in the claims forming a part of this disclosure. For better understanding of the surface contact self-sealing integrated tableware and dining mat, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
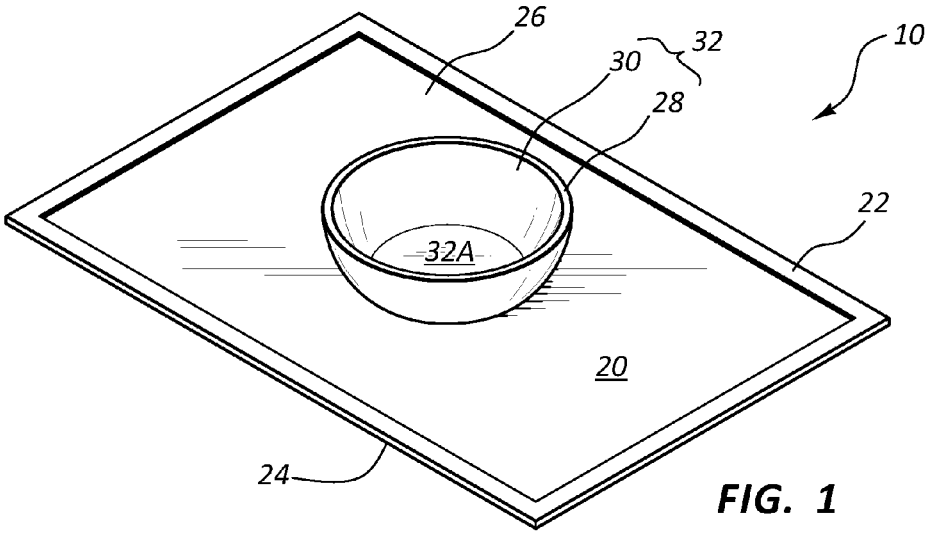
FIG. 1 is an isometric view of an example embodiment.
Figure 2:
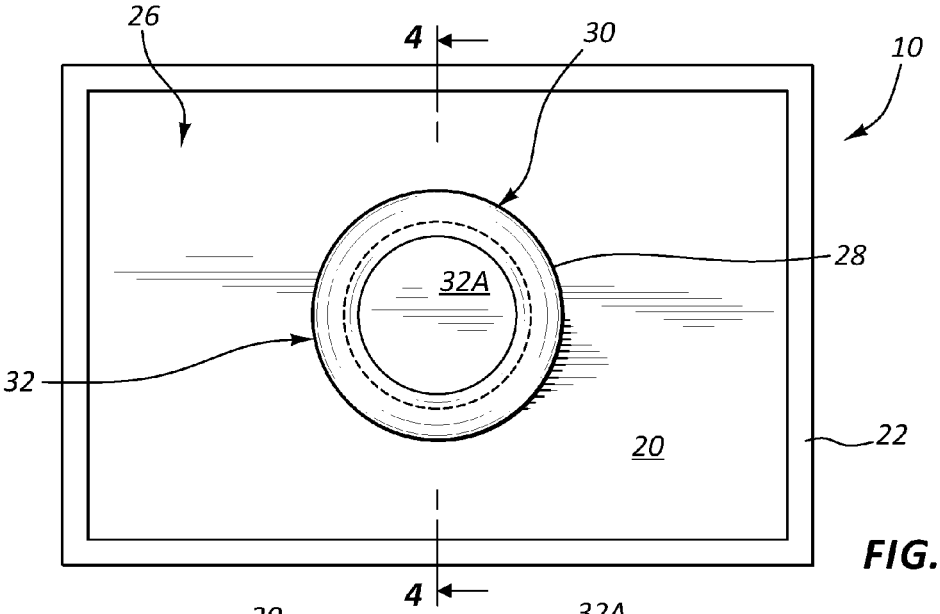
FIG. 2 is a top view of an example embodiment.
Figure 3:
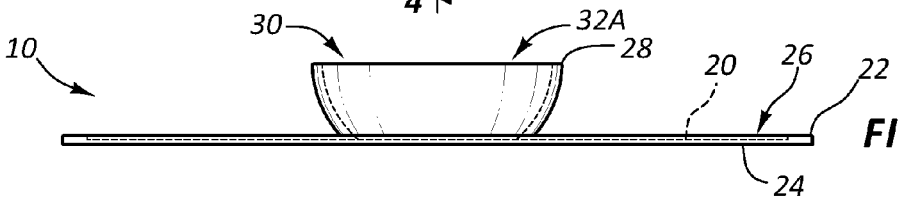
FIG. 3 is a side view of an example embodiment.
Figure 4:
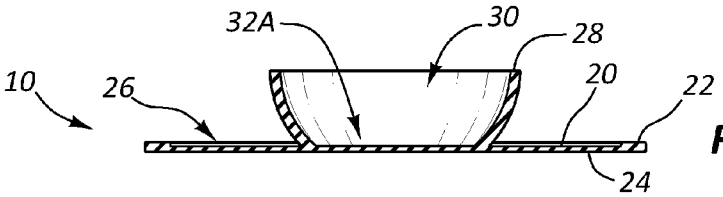
FIG. 4 is a cross section view of an example embodiment, taken along the line 4-4 of FIG. 2.
Figure 5:
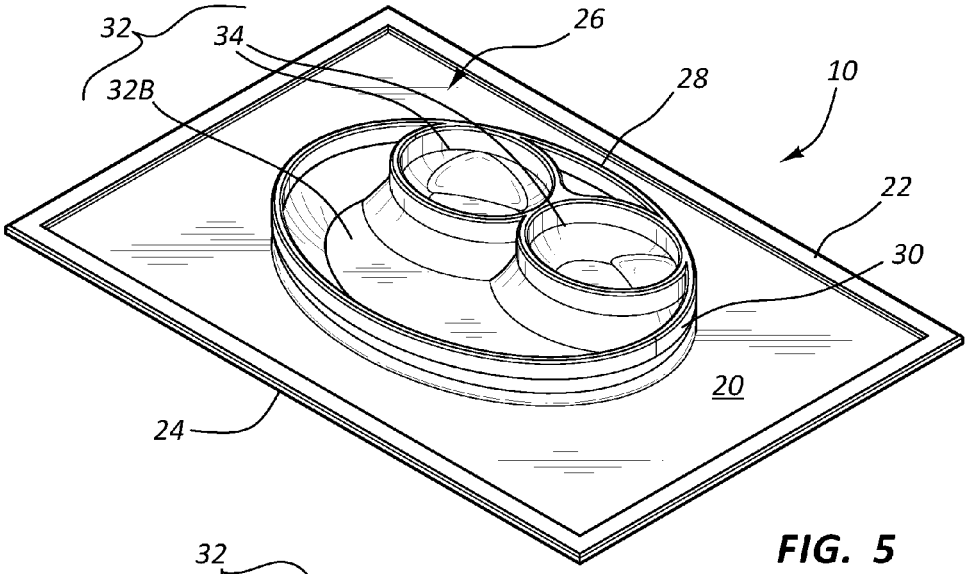
FIG. 5 is an isometric view of an example embodiment.
Figure 6:
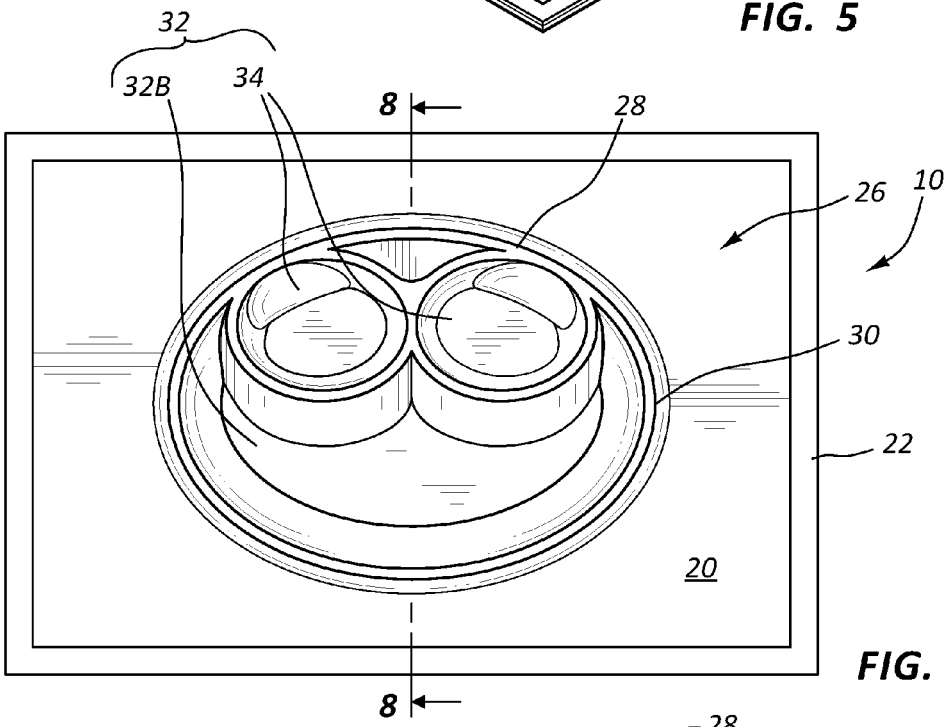
FIG. 6 is a top view of an example embodiment.
Figure 7:
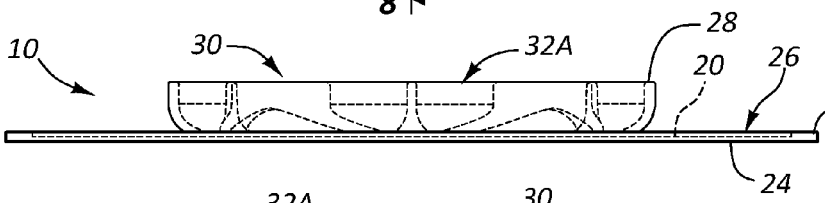
FIG. 7 is a side view of an example embodiment.
Figure 8:
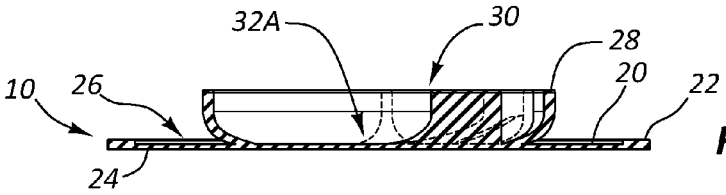
FIG. 8 is a cross section view of an example embodiment taken along the line 8-8 of FIG. 6.
Figure 9:
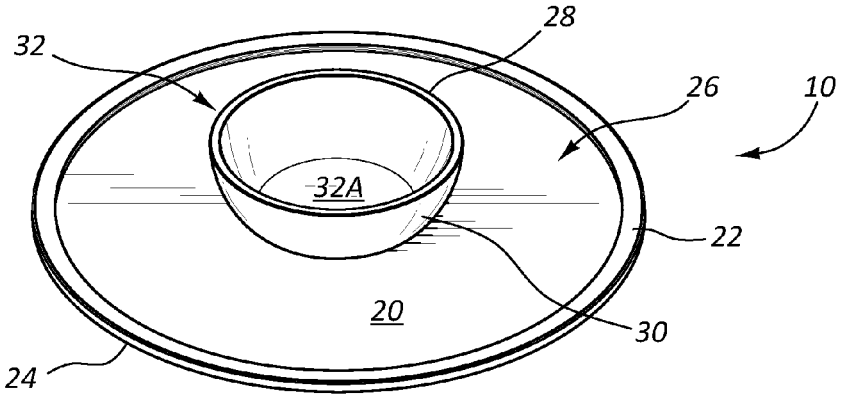
FIG. 9 is an isometric view of an example embodiment.
Figure 10:
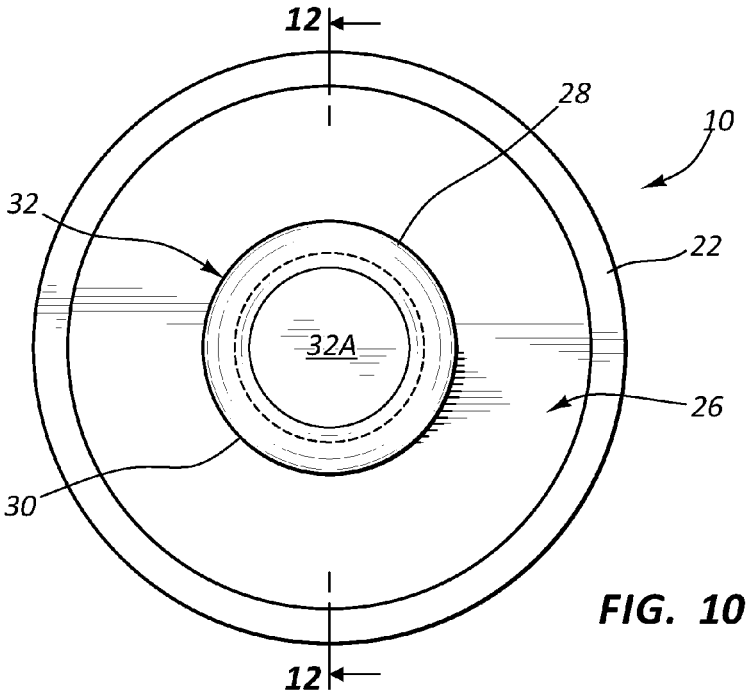
FIG. 10 is a top view of an example embodiment.
Figure 11:
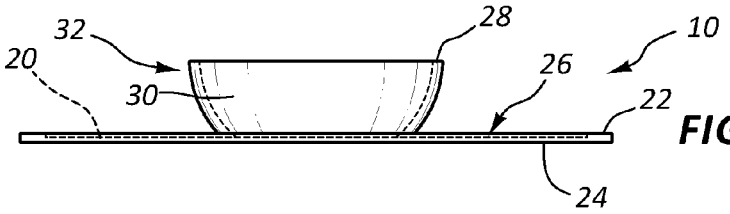
FIG. 11 is a side view of an example embodiment.
Figure 12:
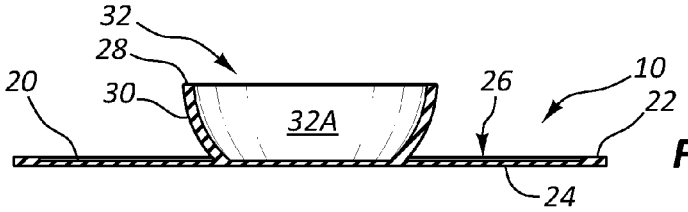
FIG. 12 is a cross section view of an example embodiment, taken along the line 12-12 of FIG. 10.

With reference now to the drawings, and in particular FIGS. 1 through 12 thereof, example of the instant surface contact self-sealing integrated tableware and dining mat employing the principles and concepts of the present surface contact self-sealing integrated tableware and dining mat and generally designated by the reference number 10 will be described.

Referring to FIGS. 1 through 12 a preferred embodiment of the present surface contact self-sealing integrated tableware and dining mat 10 is illustrated.

The present surface contact self-sealing integrated tableware and dining mat 10 has been devised to enable a choice placemat and integrated eating vessel for young children, whereby lateral displacement of the mat 10 is preventable upon a given underlying surface, such as a tabletop, for example, and food is maintained in position within the area of the mat 10.

The present surface contact self-sealing integrated tableware and dining mat 10, therefore includes a silicone planar portion 20 bounded by an outer edge 22. An undersurface 24 is suffuse upon the planar portion 20, said undersurface 24 disposed to sealably contact an underlying surface upon which the planar portion 20 is disposed. The undersurface 24 includes a high coefficient of friction, whereby the planar portion 20 is maintainable in contact with a vertically oriented surface without vertical displacement thereupon. The sealable contact further creates a partial vacuum between the undersurface 24 and an underlying surface upon which the planar portion 20 is disposed when the undersurface 24 is caused to separate from the underlying surface, whereby the undersurface 24 is maintained in contact with the underlying surface by force of atmosphere exerted upon the planar portion 20, whereby separation of the planar portion 20 from the underlying surface is preventable, except by peeling action at the outer edge 22.

The planar portion 20 further includes an upper surface 26, disposed overlying the undersurface 24. A raised perimeter 28 is disposed within the upper surface 26, said raised perimeter 28 defining a concavity 30 wrought above the upper surface of the planar portion 20 to delimit at least one receptacle 32 upon the planar portion 20. The at least one receptacle 32 is variously effected; as shown in FIGS. 1 through 4, the at least one receptacle 32 is disposed as a bowl 32A; in FIGS. 5 through 8, the at least one receptacle 32 is disposed as a shallow ovoid portion 32B, within the bounds of which ovoid portion 32B is disposed at least a pair of receptacles 34 for the selective and separable positioning of foodstuffs therein.

The at least one receptacle 32 is wrought of the same material as the planar portion 20, and may be molded thereon at time of manufacture. In the preferred embodiment herein disclosed, the planar portion 20 is rendered of silicone, or another rubberlike nontoxic polymer with a high coefficient of friction and effective of sealable, airtight contact with an underlying surface. The present surface contact self-sealing integrated tableware and dining mat 10, therefore, resists lateral displacement upon an underlying surface, such as a tabletop, as when, for example, a child attempts to push, knock, slip, or slide said tableware and dining mat 10. Moreover, the silicone or rubberlike nontoxic substrate is yielding, whereby injury from forced contact therewith is obviated.

Moreover, the silicone substrate, or nontoxic rubberlike polymer, comprising the surface contact self-sealing integrated tableware and dining mat 10 is impermeable, whereby foodstuffs and fluids are maintained from contact with the underlying surface upon which said planar portion 20 is disposed. Thus, mess created when, for example, and infant is eating is thereby catchable upon the planar portion 20 and prevented from contacting the underlying surface whereon is positioned the surface contact self-sealing integrated tableware and dining mat 10.

The present surface contact self-sealing integrated tableware and dining mat 10, therefore, sealably contacts an underlying surface and thereby prevents lateral displacement of the planar portion 20 across said underlying surface by frictional engagement therewith. Creation of a partial vacuum between the undersurface 24 and the underlying surface, when attempt is made to separate said planar portion 20 from said underlying surface, prevents unintended lifting of the planar portion 20 off of said underlying surface. A child, therefore, is prevented from lifting the present surface contact self-sealing integrated tableware and dining mat 10 from a table, for example, by grasping the at least one receptacle 32.

To remove the surface contact self-sealing integrated tableware and dining mat 10 from an underlying surface, and break contact therebetween, a user lifts the outer edge 22 of the planar portion 20 from off the underlying surface. Lifting the planar portion 20 at the outer edge 22, and peeling the planar portion 20 from the underlying surface, prevents creation of the partial vacuum by enabling entry of ambient atmosphere between the undersurface 24 and the underlying surface, whereby removal of the surface contact self-sealing integrated tableware and dining mat 10 from an underlying surface is effective.

Foodstuffs are therefore selectively positional interior to the at least one receptacle 32, said receptacle 32 thence maintained in desired position upon the underlying surface by action of the planar portion 20 sealably contacting said underlying surface, and removal of said planar portion 20 from said underlying surface is effective only when said planar portion 20 is separated from said underlying surface first at the outer edge 22 of the planar portion 20, whereby attempts by an infant to overturn, slide, slip, or otherwise displace the planar portion 20 while eating therefrom are preventable.

What is claimed is:

1. A surface contact self-sealing integrated tableware and dining mat comprising a rubberlike planar portion having a raised perimeter delimiting at least one concavity surrounding at least one receptacle above an upper surface and an entirely suffuse undersurface disposed for sealable contact with an underlying surface upon which said mat is disposed, said sealable contact preventative of lateral displacement of the planar portion across the underlying surface, wherein said sealable contact creates a partial vacuum when attempts to separate the undersurface from the underlying surface are made except at an outer edge of the planar portion, whereby removal of the planar portion from the underlying surface is effective only by peeling the undersurface from the underlying surface starting first at the outer edge.

2. The surface contact self-sealing integrated tableware and dining mat of claim 1 wherein the planar portion extends laterally beyond the raised perimeter whereby the planar portion extends surrounding the at least one concavity.

3. The surface contact self-sealing integrated tableware and dining mat of claim 2 wherein the at least one receptacle is divided therein, said at least one receptacle appropriate for holding differentiated foodstuffs therein.

4. The surface contact self-sealing integrated tableware and dining mat of claim 3 wherein the rubberlike planar portion is molded nontoxic silicone.

5. A surface contact self-sealing integrated tableware and dining mat comprising:

a nontoxic polymeric planar portion;

an outer edge parametrically bounding said planar portion;

an undersurface entirely suffuse upon the planar portion, said undersurface disposed to sealably contact an underlying surface upon which the planar portion is disposed;

an upper surface; and a raised perimeter disposed within the upper surface, said raised perimeter defining a concavity wrought above the upper surface of the planar portion to delimit at least one receptacle upon the planar portion;

wherein the undersurface sealably contacts an underlying surface upon which the planar portion is disposed, said undersurface thereby preventing lateral displacement of the planar portion upon said underlying surface by frictional engagement therewith and, further, creation of a partial vacuum between the undersurface and the underlying surface when attempt is made to remove said planar portion away from said underlying surface, whereby foodstuffs are positional interior to the at least one receptacle, said receptacle thence maintained in desired position by action of the planar portion contacting said underlying surface, and removal of said planar portion from said underlying surface is effective only when said planar portion is lifted from said underlying surface first at the outer edge of the planar portion.

6. The surface contact self-sealing integrated tableware and dining mat of claim 5 wherein the at least one receptacle is a bowl.

7. The surface contact self-sealing integrated tableware and dining mat of claim 5 wherein the at least one receptacle includes an ovoid portion and at least a pair of receptacles disposed within the bounds of the ovoid portion for separate and selective positioning of foodstuffs.

8. The surface contact self-sealing integrated tableware and dining mat of claim 5 wherein the nontoxic polymeric planar portion is silicone.

9. A surface contact self-sealing integrated tableware and dining mat comprising:

a silicone planar portion;

an outer edge parametrically bounding the planar portion;

an undersurface entirely suffuse upon the planar portion, said undersurface disposed to sealably contact an underlying surface upon which the planar portion is disposed;

an upper surface; and a raised perimeter disposed within the upper surface, said raised perimeter defining a concavity wrought above the upper surface of the planar portion to delimit at least one receptacle upon the planar portion;

wherein the undersurface sealably contacts an underlying surface upon which the planar portion is disposed, said undersurface thereby preventing lateral displacement of the planar portion upon said underlying surface by frictional engagement therewith and, further, creation of a partial vacuum between the undersurface and the underlying surface when attempt is made to separate said planar portion from said underlying surface, whereby foodstuffs are selectively positional interior to the at least one receptacle, said receptacle thence maintained in desired position upon the underlying surface by action of the planar portion contacting said underlying surface, and removal of said planar portion from said underlying surface is effective only when said planar portion is separated from said underlying surface first at the outer edge of the planar portion.

* * * * *